US007337722B2

(12) United States Patent
LaFaille

(10) Patent No.: US 7,337,722 B2
(45) Date of Patent: Mar. 4, 2008

(54) METHOD AND DEVICE FOR PRINTING OBJECTS

(75) Inventor: Marc Maria Leo Jan LaFaille, Kapellen (BE)

(73) Assignee: Akzo Nobel Coatings International B.V., Arnhem (NL)

( * ) Notice: Subject to any disclaimer, the term of this patent is extended or adjusted under 35 U.S.C. 154(b) by 303 days.

(21) Appl. No.: 10/516,008

(22) PCT Filed: May 23, 2003

(86) PCT No.: PCT/BE03/00093

§ 371 (c)(1),
(2), (4) Date: Jan. 11, 2005

(87) PCT Pub. No.: WO03/101749

PCT Pub. Date: Dec. 11, 2003

(65) Prior Publication Data

US 2005/0145121 A1 Jul. 7, 2005

(30) Foreign Application Priority Data

May 31, 2002 (BE) ..... 2002/0358

(51) Int. Cl.
*B41F 17/00* (2006.01)
*B41F 17/18* (2006.01)

(52) U.S. Cl. ..... 101/492; 101/493; 101/41

(58) Field of Classification Search ..... 101/41, 101/163, 492, 493
See application file for complete search history.

(56) References Cited

U.S. PATENT DOCUMENTS

| | | | | |
|---|---|---|---|---|
| 3,868,901 | A * | 3/1975 | Valiela | 101/41 |
| 4,532,175 | A * | 7/1985 | Johnson et al. | 428/220 |
| 5,090,320 | A * | 2/1992 | Nave | 101/485 |
| 5,731,033 | A | 3/1998 | Hanisco | |
| 5,890,429 | A | 4/1999 | Alam et al. | |
| 6,691,609 | B1 * | 2/2004 | Lafaille et al. | 101/93 |
| 7,267,055 | B2 * | 9/2007 | Weiss et al. | 101/491 |
| 2003/0116047 | A1 * | 6/2003 | Cutcher | 101/492 |
| 2005/0150592 | A1 * | 7/2005 | LaFaille | 156/239 |
| 2006/0283344 | A1 * | 12/2006 | Ferguson | 101/492 |

FOREIGN PATENT DOCUMENTS

| | | |
|---|---|---|
| BE | 1 012 584 A3 | 12/2000 |
| EP | 0 110 220 A | 6/1984 |
| JP | A 04-126286 | 4/1992 |
| JP | A 05-085027 | 4/1993 |
| JP | A 06-297827 | 10/1994 |
| WO | WO 00/61376 A1 | 10/2000 |

* cited by examiner

*Primary Examiner*—Leslie J. Evanisko
(74) *Attorney, Agent, or Firm*—Kenyon & Kenyon LLP

(57) ABSTRACT

Method for printing objects (2) whereby printing ink (5) or the like is provided on a carrier (3) which consists of a flexible, mainly flat material layer on the one hand, and whereby the printing ink (5) is transferred to the object (2) to be printed by bringing the above-mentioned carrier (3) and the object (2) into contact with one another, characterized in that additional means are implemented which promote the reproducibility during printing.

8 Claims, 3 Drawing Sheets

METHOD AND DEVICE FOR PRINTING OBJECTS

FIELD OF THE INVENTION

The present invention concerns a method for printing objects, in particular for printing the surface of three-dimensional objects, among others for applying an ornamental coating, letters or the like on the housing of portable telephones.

BACKGROUND OF THE INVENTION

From Belgian patent No. 1,012,584 is known a method for realising such a print, whereby printing ink or the like is provided on a carrier which consists of a flexible, mainly flat material layer on the one hand, and whereby the printing ink is transferred to the object to be printed by bringing the above-mentioned carrier and the object into contact with one another.

Although the known method generally provides good results, it has been found that it sometimes occurs that the prints on the objects represent small variations in relation to each other.

Also, the invention aims to remedy this.

SUMMARY OF THE INVENTION

To this end, the invention in the first place concerns a method for printing objects whereby printing ink or the like is provided on a carrier on the one hand which consists of a flexible, mainly flat material layer, and whereby the printing ink is transferred to the object to be printed by bringing the above-mentioned carrier and the object into contact with one another, characterised in that additional measures are taken and/or additional means are implemented which promote the reproducibility during printing.

By making use of such additional means, it can be guaranteed with more certainty that unwanted variations will be avoided or will be strongly minimised.

According to a first embodiment of the method according to the invention, as an additional measure, at least for the above-mentioned carrier, use will be made of a flexible material layer which is obtained by letting a liquid substance cure whereby, during the curing, an attachment to a holder has been provided for.

In this manner is obtained that, after the flexible material layer has been cured, a carrier is formed which is attached to the holder as a membrane and which, when neglecting the influence of the very small own weight of the material layer, is almost completely stress-free. Thus, by applying this method according to the invention, carriers can be made which are characterised in that, when unloaded, they are stress-free in an identical and uniform manner in each point. This offers the advantage that, when such carriers are replaced, for example due to wear or a defect, a new carrier will have exactly the same characteristics as the preceding carrier, such that the new carrier will behave in an identical manner as the old carrier while similar objects are being printed, which guarantees the continuity as far as quality and reproducibility of the printing are concerned.

The method will preferably consist in that the carrier is formed and is fixed to the holder as well by positioning the holder at a short distance above a mainly horizontal base on the one hand, which base adheres little or not at all to the material out of which the carrier has to be formed, and by casting the material out of which the carrier is to be formed as a liquid substance on the base on the other hand, such that the holder and the liquid material make contact, and next, after the liquid material has cured and has been fixed to the holder by making contact with it, in removing the holder from the base, together with the carrier formed by curing which has been fixed to it by then. It is clear that such carriers according to the method can be realised in a very simple manner with reproducible characteristics on top of it.

According to a preferred characteristic, use is made of silicones or a composition on the basis of silicones as a material for the carrier, which offers the advantage that the material is inexpensive and easily available. Moreover, in practice it appears that a material layer on the basis of silicones offers ideal qualities to be used as a carrier for transferring printing ink on three-dimensional objects.

According to a second embodiment of the method according to the invention, this method consists in that, as an additional measure, and also as an additional means, use is at least made of a holder for the above-mentioned carrier, which holder is made as an interchangeable element together with the carrier, such that the carrier can be very easily exchanged without the carrier having to be detached first, as is the case with the known printing techniques, and in that, subsequently, the new carrier has to be fixed and stretched again.

As it is thus possible to use carriers which are fixed on a holder outside the printing device, fixing techniques can be applied which allow for all carriers to be always fixed on the holders with the same characteristics as far as stress and the like are concerned, which is otherwise very difficult when the carrier is stretched directly in the device for printing the objects.

What precedes does not exclude that, when the carrier is applied, pre-stress is nevertheless created in the carrier, for example by bringing it into contact with a frame, such that the carrier is pressed by the frame and is stretched flatly inside said frame. By for example each time applying a frame with the same dimensions and by each time pressing it according to the same movement against the carrier, the use of such a frame has no influence whatsoever on the reproducibility of the images to be printed.

According to a third embodiment of the method according to the invention, just as with the known method, the above-mentioned carrier is at least partially forced around the object to be printed while printing an object by means of a gas pressure difference, but a counter support, preferably in the shape of a counter plate, is additionally applied which restricts the deformation of the carrier next to the object. Thus is avoided that the carrier is stretched out too much at the time when said gas pressure is applied, as a result of which the printing motive applied onto it might be deformed.

According to a fourth embodiment, in order to transfer the printing ink to the object to be printed, this object is pressed against the carrier, such that the carrier is at least moved and is at least partially stretched, or is stretched further if it had already been stretched at first, and a counter piece is used as an additional means according to the invention, situated opposite to the object to be printed on the other side of the carrier, and which consists of a compressible and/or deformable material. The advantage of such a compressible and/or deformable counter piece is that it can be used for objects having different shapes, as opposed to the known method whereby a hard negative counter mould is used for every different shape of the objects to be printed.

The position of this counter piece is preferably also adjustable, for example in height.

Moreover, by carefully selecting the material out of which the compressible and/or deformable counter piece is made, the carrier will be pressed with certainty against all the wall parts of the object to be printed, i.e. also against the wall parts which otherwise, when using a hard counter mould, are difficult to reach, such as for example the inwardly directed wall parts of the front side of a mobile phone which form passages for the keys. Use will preferably be made to this end of an elastically compressible cushion made of foam plastic or of a gel or gel coating contained in an envelope.

Moreover, the working of such a compressible counter piece is not subject to wear, as is the case with a hard counter mould, as a result of which the quality of the print remains constant in time.

It is clear that the above-mentioned four embodiments can be combined at will.

The invention also concerns a device for printing objects, in particular according to the method as described above, characterised in that it comprises one of the following or a combination of two or several of the following additional means:

- a carrier fixed to a holder, whereby the carrier consists of a flexible material layer obtained by making a liquid substance cure whereby, while it cures, an attachment to the holder is formed;
- a carrier fixed to a holder, exchangeable as a whole in the device;
- a counter support which restricts the deformation of the carrier next to the object in the case where the above-mentioned carrier is at least partially forced around the object to be printed by means of a gas pressure difference;
- a counter piece which can work in conjunction with the side of the carrier situated opposite to the side which makes contact with the object to be printed, whereby this counter piece consists of a compressible and/or deformable material.

In order to better explain the characteristics of the invention, the following preferred embodiment of a device applying the method according to the invention is described as an example only without being limitative in any way, with reference to the accompanying drawings.

DETAILED DESCRIPTION

Figure 1:
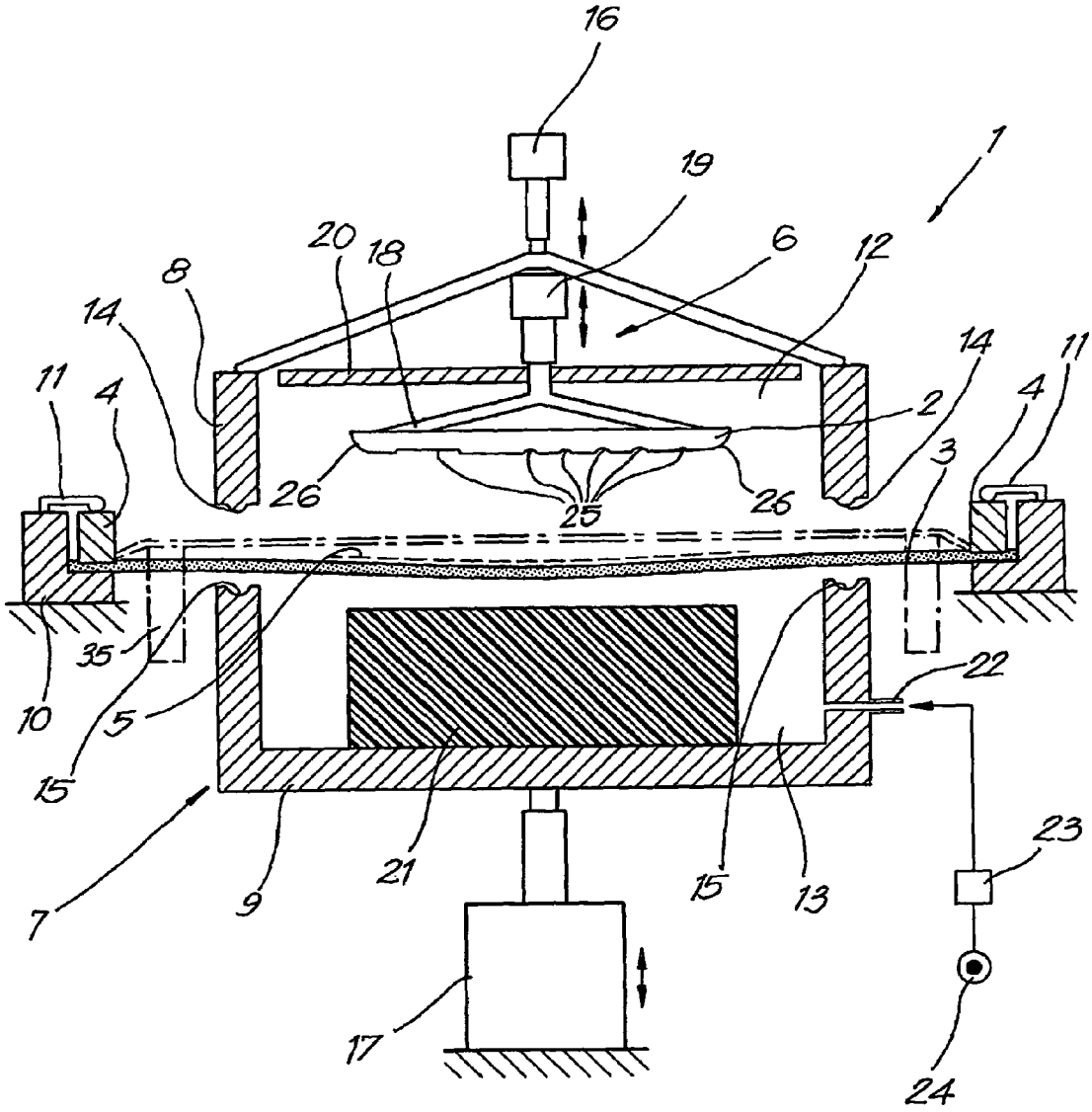
FIG. 1 schematically represents a device for printing an object, whereby use is made of the method according to the invention.
Figure 2:
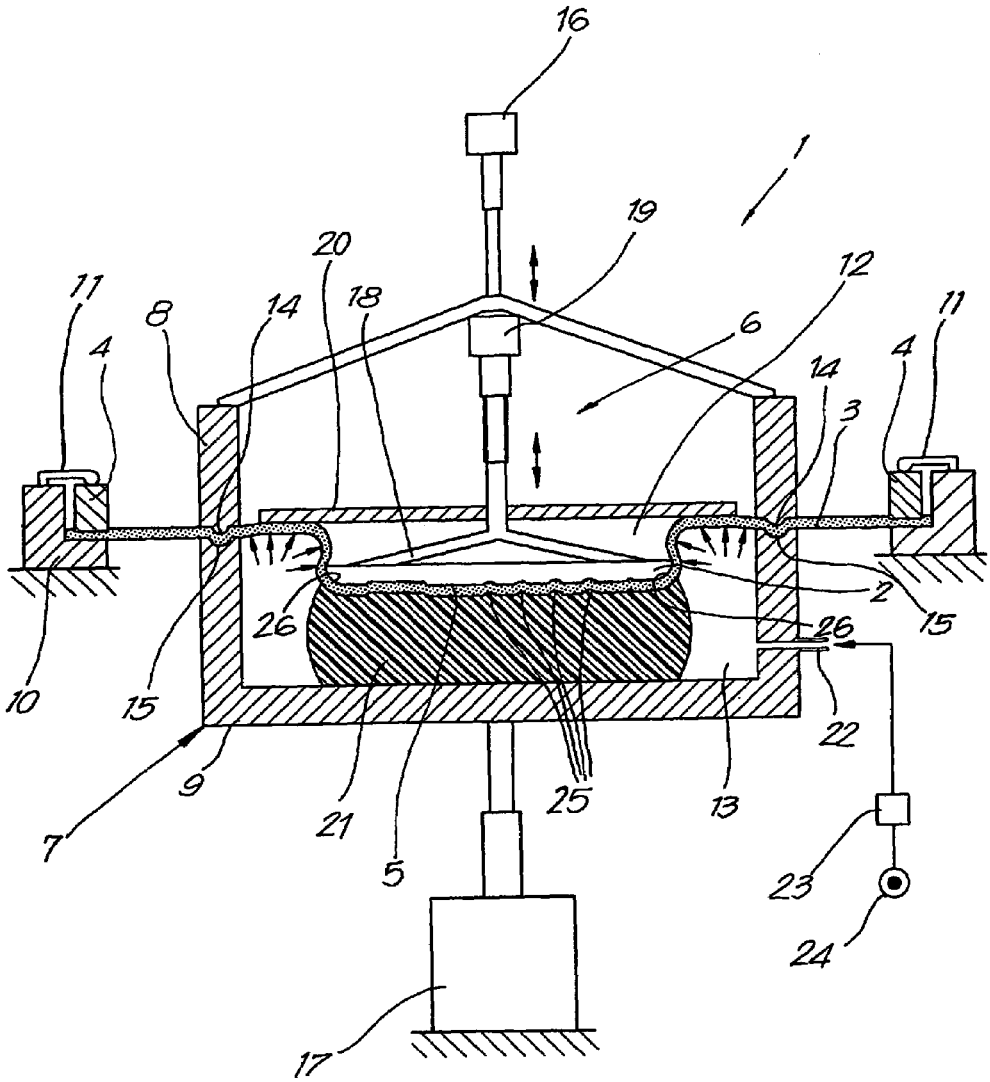
FIG. 2 represents a second characteristic position of the device according to FIG. 1.

FIGS. 1 and 2 represent a device 1 for printing three-dimensional objects 2, in this case for printing front sides of mobile phones. It is clear, however, that the invention can also be applied for printing all sorts of other objects.

The device 1 comprises a carrier 3 which consists of a flexible, mainly flat material layer which is fixed to a holder 4, in particular fastened to it, and upon which is provided printing ink 5 or the like on one side, in this case on the top side, according to a specific pattern, and whereby this printing ink 5 is transferred to the object 2 to be printed by bringing the object 2 in contact with the carrier 3 by means of means 6 described hereafter.

Moreover, the device 1 comprises a two-part central part 7 with a top part 8 which fits on a lower part and in between which the carrier 3 is provided.

The carrier 3 is fixed in support 10 by means of clamps 11 or the like in an exchangeable manner together with its holder 4, and it divides the central part 7 in two compartments, a top compartment 12 in the top part 8 and a lower compartment 13 in the lower part 9 respectively.

The edges of the top part 8 are provided with a downward directed rib 14 which can work in conjunction with a corresponding groove 15 provided in the edges of the lower part 9.

According to a variant, the above-mentioned edges can also be simply flat.

The top and lower part, 8 and 9 respectively, can be moved in relation to one another in a vertical direction by means of drives 16 and 17 respectively.

In the top part 8 is provided an object holder 18 for fixing the objects 2 to be printed.

In the given example, the above-mentioned means 6 consist of a drive 19 which can move the object holder 18 vertically in relation to the top part 8.

Naturally, according to variants which are not represented, these means 6 may consist of any other elements whatsoever which make it possible for the object 2 and the carrier 3 to be moved mutually towards one another.

Thus, for example, according to a variant, the object holder 18 and the drive 19 are made in the shape of a robot arm.

According to another variant, the drives 16 and 19 can be made in common, for example by making use of a pressure cylinder which carries along the part 8 as well as the object holder 18 during the first part of its length of stroke, until the part 8 ends up on the part 9, after which the pressure cylinder extends further, thereby only taking along the object holder 18 so as to bring it into contact with the carrier 2.

Further, the device 1 comprises a counter support 20, in this case in the shape of a horizontal supporting plate which moves together with the object holder 18.

In the lower part 9, opposite to the object 2 to be printed on the other side of the carrier 3, is provided a counter piece 21 in the shape of an elastically compressible cushion, preferably made of foam plastic, which counter piece may also consist of a deformable mass according to a variant, such as a gel contained in an envelope.

The lower part 8 is made as a chamber, such that when its top side is sealed by the carrier 3, a space is obtained which is entirely shut off from the environment, corresponding to the lower compartment 13, under the carrier 3.

In a side wall of the compartment 13 which is thus formed by the lower part 9 is provided a compressed air connection 22 upon which is connected a pressure source 24, for example a compressed air installation or the like, via a valve 23.

The use and working of the device is as follows.

In the object holder 18 is provided an object 2 to be printed on the one hand.

When an object 2 has been previously printed, the central part 7 is opened to this end by means of the drives 16 and 17, such that an object 2 which has possibly been printed before can be taken from the object holder 18 and can be replaced by a following object 2 to be printed.

Printing ink 5 or the like is provided according to a certain pattern on the top side of the carrier 3 on the other hand. By printing ink 5 or the like are understood all sorts of printing media, including all liquids which are usually regarded as printing ink as well as other liquids, dyes, powders and the like which, as is known, are used for printing objects 2.

This printing ink 5 or the like can be applied on the carrier 3 according to all sorts of techniques which may be for example known as such, for example by means of printing techniques, spraying techniques, tampon printing, silkscreen printing and the like.

In principle, the printing ink can be applied while the carrier 3 is situated between the parts 8-9, but it can also be done in another place, for example as the support 10 can be moved together with the holder 4 and the carrier 3 fixed in it between the position represented in the figures on the one hand, and a station, situated for example next to it, where the printing ink 5 or the like is applied on the carrier 3 on the other hand.

After the carrier 3 has been provided with printing ink 5, the central part 7, as represented in FIG. 2, is sealed by the top part 8 and the lower part 9 by pressing the drives 16 and 17 onto each other, whereby the carrier 3 is clamped between the ribs 14 and the grooves 15 of these parts 8-9, so that the lower compartment 13 is sealed air-tight.

It should be noted that the use of such ribs 14 and grooves 15 is optional. Depending on the carrier 2 and the application, flat edges can be applied, or it may even be desirable to apply flat edges. When the carrier 2 consists for example of silicones, such a seal is already obtained with flat edges. In case of large storages, it is even desirable to apply flat edges when silicones are used, as the ribs 14 and the grooves 15 might otherwise cause permanent unwanted deformations in the silicone membrane.

Next, by means of the drive 19, the object holder 18 is moved down together with the object 2 to be printed and the counter support 20, so that, in order to transfer the printing ink 5, the object 2 is pressed against the carrier 3, and the centre part of this carrier 3 is moved and stretched against the lower part of the object 2.

By pressing the object holder 18 further down, the object 2, together with the carrier 3, is pressed against the flexible counter piece 21, as a result of which said deformable counter piece 21 penetrates in all the unevennesses 25 of the object 2 to be printed, for example, as in the given example, into the passages for the keys of a mobile phone, such that the printing ink 5 is also transferred onto the walls of said unevennesses 25.

The lower compartment 13 is put under pressure via the compressed air connection 22, so that the carrier 3 which seals this compartment 13, due to the gas pressure difference between the top side and the lower side of the carrier 3, is forced around the edges 26 of the object 2 to be printed, as a result of which the printing ink 5 is transferred to the object 2 concerned on these places as well.

As can be seen in FIG. 2, the counter support 20 prevents the carrier 3 from being stretched out too much due to the difference in gas pressure, and, consequently, it prevents the transferred print from being deformed. In particular, the upward bulge of the carrier 3 is restricted by means of this counter support 20.

The object 2 is provided with a print in this stage and subsequently, after the compressed air connection 22 has been cut off and after the central part 7 has been opened, it is removed from the object holder 18 so that a following object 2 to be printed can be applied.

In order to be able to guarantee reproducible results for printing the objects 2, especially after a worn or damaged carrier 3 has been replaced, use is preferably made of a carrier 3 according to the invention, as explained in the introduction, which consists of a flexible material layer obtained by making a liquid substance cure, preferably silicones or a composition on the basis of silicones, whereby, while it cures, an attachment to the holder 4 is formed.

This special technique is described hereafter on the basis of FIGS. 3 to 6.

The device 27 used hereby mainly consists of a mould 28 in the shape of a horizontally erected tray with side walls 29 and a bottom 30 on the one hand, and of fastening means 31 for suspending a holder 4 in the mould 28 at a small height H above the bottom 30 on the other hand.

The bottom 30 of the mould 28 is preferably made of a material which adheres little or not at all to the material out of which the carrier 3 has to be formed, or it may possibly be provided with a non-adhering layer of such material, and it preferably has dimensions which correspond to or are slightly larger than the surface of the carrier 3 to be realised.

The holder 4 in this case consists of a frame made of wood or the like, but other materials, for example PVC, metal and the like, are not excluded.

Figure 3:
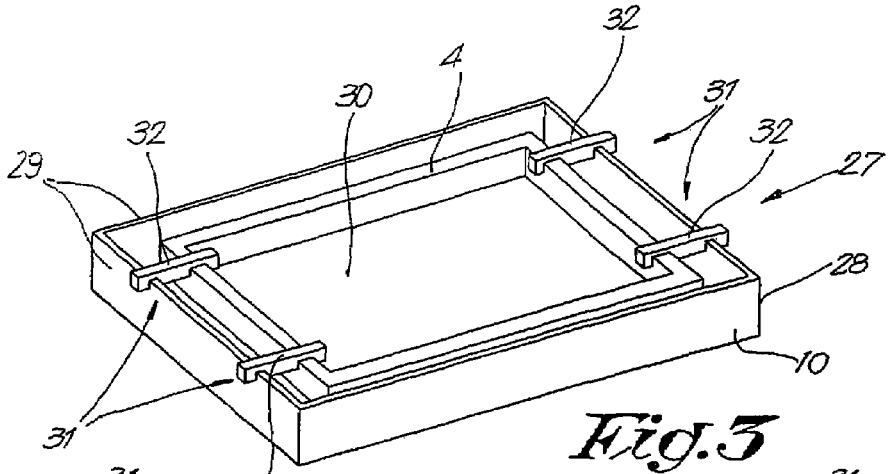
FIG. 3 represents a device for manufacturing a carrier according to the method of the invention, schematically and in perspective.
Figure 4:
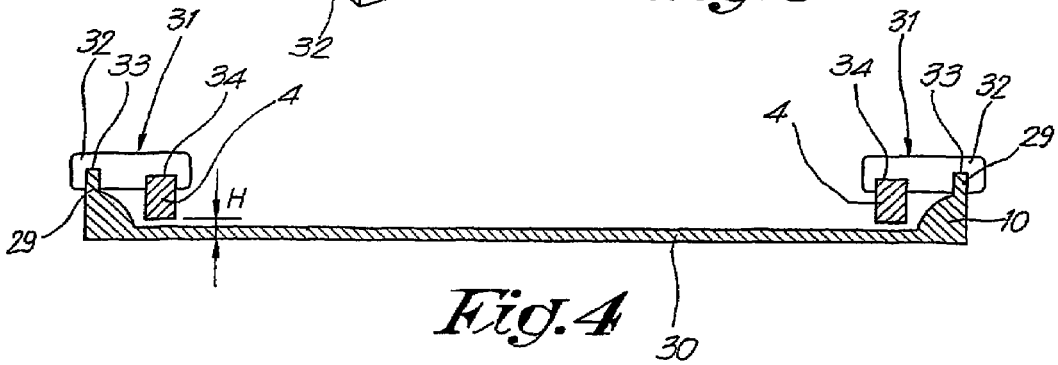
FIG. 4 represents a section according to line II-II in FIG. 3.
Figure 5:
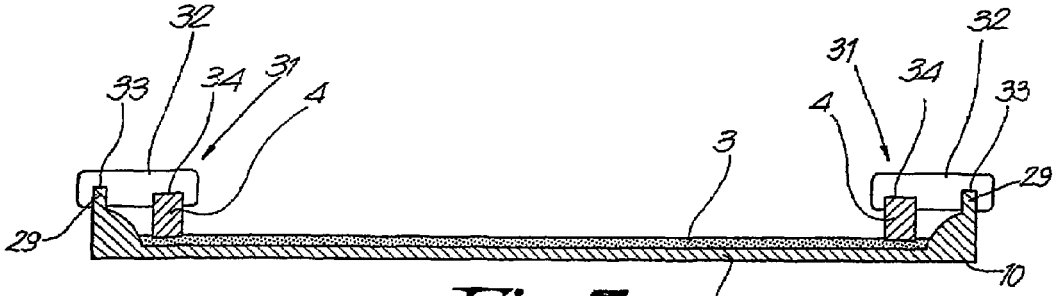
FIGS. 5 and 6 represent views which are similar to that of FIG. 4, but for two other positions.

In the case that such a frame is used for the holder 4, the fastening means 31 may be formed of elements 32 with which this frame, as represented in FIGS. 3 to 5, can be suspended on the side walls 29 of the mould 25. In the given example, these elements 32 are provided with notches, 33 and 34 respectively, with which they can be provided over the side walls 29 and over the holder 4, so as to retain the holder 4 at said distance H by means of clamping.

According to a variant which is not represented, the bottom side of the holder 4 is provided with a moulded pattern, for example with grooves, which offers the advantage that the contact surface is enlarged and that a better adhesion of the carrier material onto the holder 4 is obtained.

In order to form the carrier 3, as represented in FIG. 5, the above-mentioned liquid substance on the basis of silicones is cast on the bottom 30 of the mould 28 until the liquid substance makes contact with the bottom side of the holder 4. After the liquid substance has cured, a flexible material layer is obtained which adheres to the holder 4, such that the holder 4, as represented in FIG. 6, can be removed from the mould 28 together with the material layer attached to it.

Thus is obtained a carrier 3 which is made as an interchangeable element together with the holder 4 and which is particularly suitable to be used in the above-described device 1 for printing three-dimensional objects 2.

Figure 6:
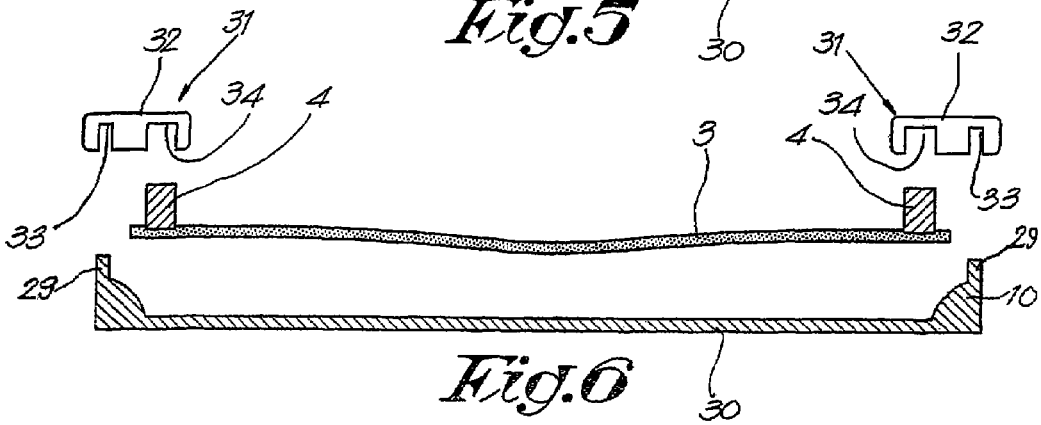

As the carrier 3 has been obtained by curing a liquid substance at rest, there will be no stress whatsoever in the cured carrier 3, at least when abstracting the negligible stress caused by the sagging of the carrier 3, as represented in FIG. 6, under the influence of its own weight.

All carriers 3 formed according to this method have the same characteristics and consequently behave identically during the printing process, as a result of which the printing is entirely reproducible with certainty, even if the carrier 3 has to be replaced for some reason or other.

The present invention is by no means limited to the above-described embodiments given as an example and represented in the accompanying drawings; on the contrary, such a method and device can be made in all sorts of variants while still remaining within the scope of the invention.

Thus, for example, according to a variant, the carrier 2 can already be stretched prior to the actual printing process. According to this variant, as is schematically indicated in FIG. 1, use can be made of a frame 35 or the like which makes sure, when the holder 4 is provided in the support 10, that the carrier 2 is initially stretched. The current 35 can be mounted fixed or it may be moveable so that it can be brought into contact with the carrier 2 if required. Creating such pre-stress is advantageous in that the carrier is always perfectly flat, so that the ink cannot bleed and/or ink drops will not move over the surface of the carrier 2.

The invention claimed is:

1. A method for printing objects comprising a) providing printing ink on a carrier which consists of a flexible, mainly flat material layer, b) transferring the printing ink to an object to be printed by bringing the carrier and the object into contact with one another, and c) taking an additional measure to promote the reproducibility during printing, the additional measure comprising curing a liquid substance to obtain the flexible material layer such that during the curing an attachment to a holder is provided for;

wherein the carrier is formed and fixed to the holder by (i) positioning the holder at a short distance above a mainly horizontal base, which base adheres little or not at all to the material out of which the carrier is formed, (ii) casting the liquid substance on the base such that the holder and the liquid substance make contact, (iii) curing the liquid substance and fixing it to the holder by making contact with it, and (iv) removing the carrier formed by curing the liquid substance, together with the holder, from the base.

2. Method according to claim 1, wherein the material out of which the carrier is formed is silicones or a composition on the basis of silicones.

3. Method according to claim 1, wherein the holder is a wooden frame.

4. Method according to claim 1, wherein the combination of holder and carrier is implemented as an interchangeable element.

5. Method according to claim 1, wherein the carrier is forced at least partially around the object to be printed by means of a gas pressure difference and wherein a counter support is applied which restricts the deformation of the carrier next to the object.

6. Method according to claim 5, wherein the counter support is a counter plate.

7. Method according to claim 1, wherein the object to be printed is pressed against the carrier, such that the carrier is moved and is at least partially stretched, and wherein a counter piece consisting of a compressible or deformable material is situated on the side of the carrier not facing the object to be printed.

8. Method according to claim 7, wherein the compressible material is an elastically compressible cushion.

* * * * *